US005088838A

United States Patent [19]

Yeh

[11] Patent Number: 5,088,838

[45] Date of Patent: Feb. 18, 1992

[54] FOLDABLE WATER CONTAINER

[76] Inventor: Yun-Hui Yeh, 2F, No. 11-15, Lane 22, Kuang Fu S. Rd., Taipei, Taiwan

[21] Appl. No.: 688,430

[22] Filed: Apr. 22, 1991

[51] Int. Cl.[5] ..... B65D 30/20; B65D 33/02

[52] U.S. Cl. ..... 383/33; 220/9.3

[58] Field of Search ..... 383/33, 34, 34.1, 12; 220/9.3

[56] References Cited

U.S. PATENT DOCUMENTS

| | | | |
|---|---|---|---|
| 2,527,746 | 10/1950 | Lawrence | 383/33 |
| 2,901,016 | 8/1959 | Wilbricht | 383/12 |
| 2,958,357 | 11/1960 | Vorgan | 220/9.3 |
| 4,021,994 | 5/1977 | Mainprice | 383/12 |
| 4,090,542 | 5/1978 | Hacker, Jr. | 383/33 |
| 4,620,319 | 10/1986 | Sheehan et al. | 383/33 |

*Primary Examiner*—Stephen P. Garbe

*Attorney, Agent, or Firm*—Morton J. Rosenberg; David I. Klein

[57] ABSTRACT

A foldable water container comprising a tetragonal body having a quadrilateral supporting frame pivotably secured to one of the four ton edges thereof, a retaining channel made around the other three top edges, and a plurality of fold lines. The quadrilateral supporting frame is engaged in the channel to stretch open the body of the water container when the water container is in use. The quadrilateral supporting frame is disengaged from the channel permitting the body of the water container be folded up through the fold lines into a flat structure when the water container is not in use.

2 Claims, 4 Drawing Sheets

FOLDABLE WATER CONTAINER

BACKGROUND OF THE INVENTION

The present invention relates to water containers and relates more particularly to such a water container which can be folded up into a flat structure to greatly reduce space occupation when it is not in use.

According to conventional methods, a water container is generally made in a fixed structure for containing water, which can not be folded up or collapsed when it is not in use. Therefore, conventional water containers are difficult to carry to the outside for use to contain or take water during outdoor activities and, much space should be used for storing conventional water containers when they are not in use.

SUMMARY OF THE INVENTION

The present invention has been accomplished to eliminate the aforesaid problems. It is therefore the main object of the present invention to provide a foldable water container which can be conveniently folded up into a flat structure to greatly reduce space occupation when it is not in use.

According to one aspect of the present invention, there is provided a foldable water container made from flexible, water-proof material which is generally comprised of a tetragonal body having a plurality of folding lines made thereon through which said body can be folded up into a flat structure.

According to another aspect of the present invention, there is provided a foldable water container made from flexible, water-proof material which is generally comprised of a tetragonal body having a quadrilateral supporting frame pivotably internally secured thereto at the top and a channel around the top edge thereof, wherein the quadrilateral supporting frame can be engaged in the channel to stretch open the body of the water container or disengaged therefrom permitting the body of the water container to be folded up into a flat structure.

BRIEF DESCRIPTION OF THE DRAWINGS

The present invention will now be described by way of example, with reference to the annexed drawings, in which.

DETAILED DESCRIPTION OF THE PREFERRED EMBODIMENT

Figure 1:
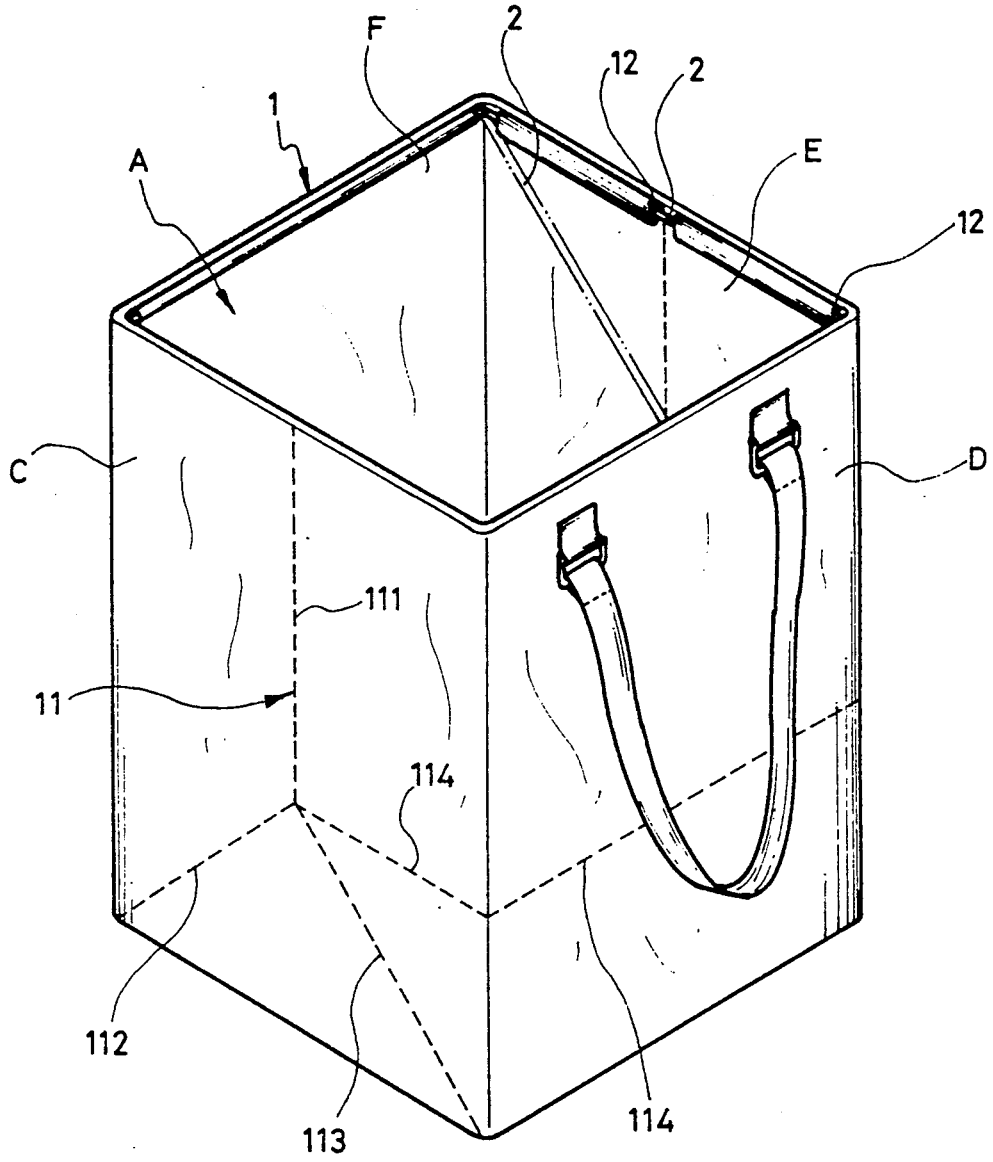
FIG. 1 is a perspective view of the preferred embodiment of the foldable water container of the present invention when it is stretched.
Figure 2:
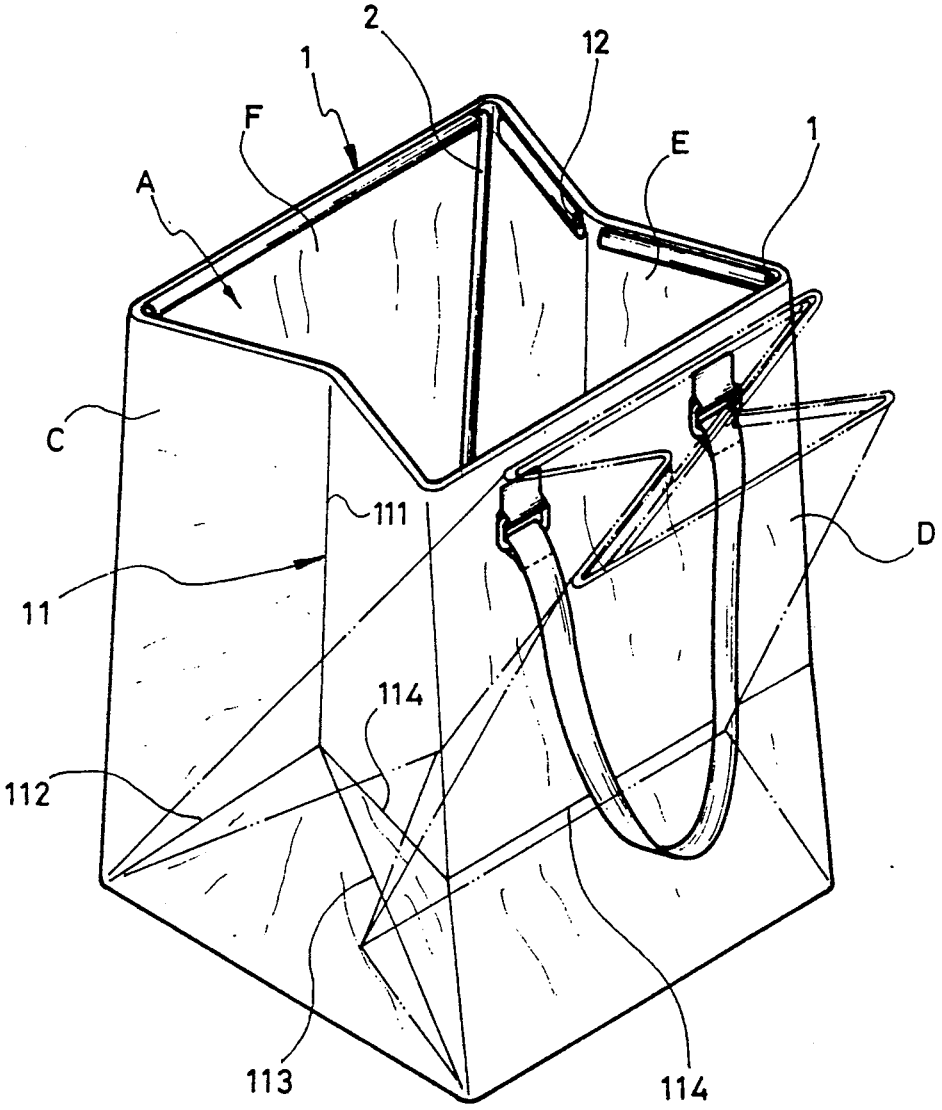
FIG. 2 is a perspective view of the preferred embodiment of the foldable water container of the present invention wherein the supporting frame therein is released permitting the body thereof to be folded up.
Figure 3:
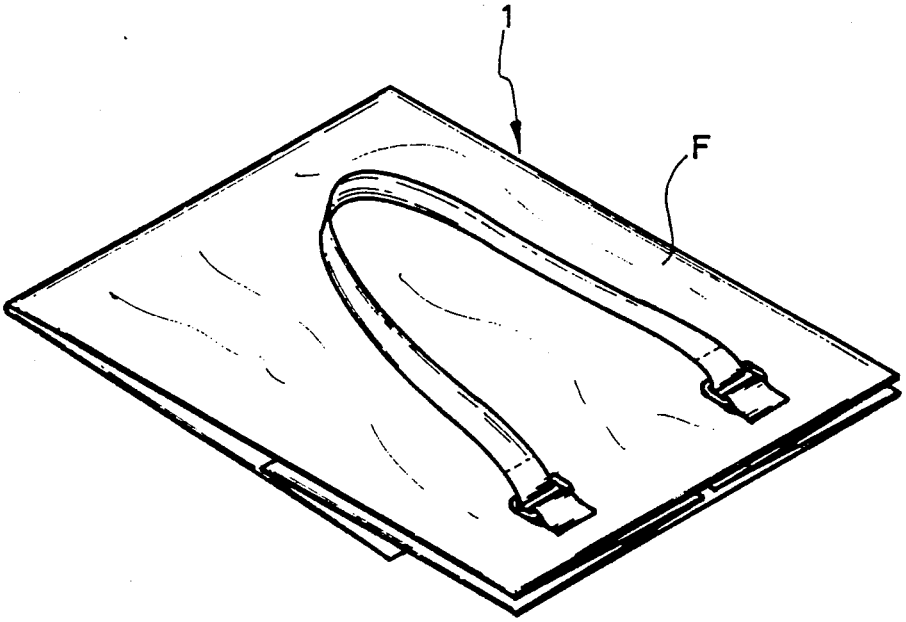
FIG. 3 illustrates that the foldable water container is folded up into a flat structure.

Referring to FIG. 1, therein illustrated is the preferred embodiment of the foldable water container of the present invention which is generally comprised of a tetragonal body 1 made from PVC or suitable flexible, water-proof material, having a top opening A, a bottom panel B and four side panels C, D, E and F. Two fold lines 11 are so made on side panels C, D and E (as shown in the dotted lines in FIG. 1) that the folding water container can be folded up into a flat structure as shown in FIGS. 2 and 3. As illustrated in FIG. 1, each fold line 11 includes first segment 111 vertically extending downward from the top edge of side panel C or E at the middle, a second and a third segment 112 and 113 respectively extending from the bottom end of said first segment 111 to the two opposite ends of the bottom edge of panel C, and a fourth segment 114 transversely extending from the point of intersection between said first, second and third segments toward side panel D to merge into the fourth segment from the fold line in the opposite side panel E.

Figure 4:
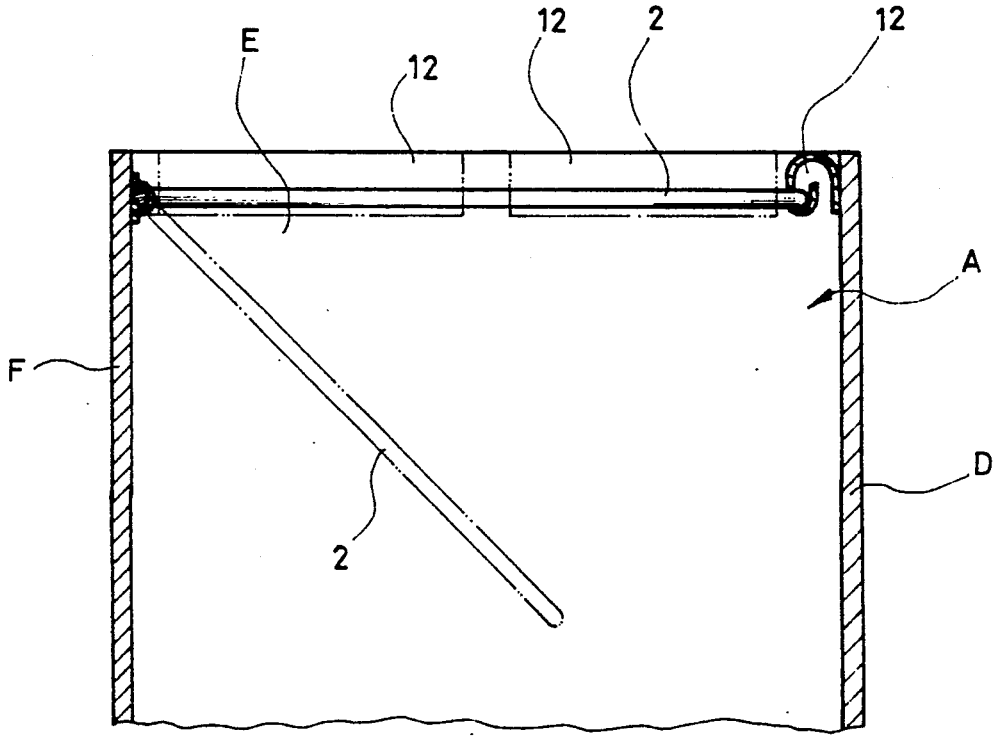
FIG. 4 is a schematic drawing illustrating that the supporting frame is engaged in the channel to stretchthe body of the foldable water container.

Referring to FIG. 4, there is provided a quadrilateral supporting frame 2 made from metal rod in size and shape corresponding to the top opening A and pivotably secured to side panel F at the top. A channel 12 which is made form resilient metal sheet or plastic material is made on the body 1 around the top edge of side panels C, D and E. By engaging the other three sides of the quadrilateral supporting frame 2 in the channel 12, the body 1 is stretched into shape for containing water. When not in use, the supporting frame 2 is disengaged from the channel 12 and rotated downward to closely attach to side panel F permitting the body 1 to be folded up through the fold lines 11 into a flat structure for carrying or storage with less space occupation.

What is claimed is:

1. A foldable water container, comprising:

a tetragonal body having a top opening, a bottom panel and four side panels, said four side panels including a first side panel, a second side panel connected to said first side panel at one side, a third side panel connected to said first side panel at an opposite side and a fourth side panel connected between said second and third side panels opposite to said first side panel;

two fold lines respectively made on said second and third side panels, each of said fold lines including a first segment vertically extending downward from the top edge of said second or third side panel, a second and a third segment respectively extending from the bottom end of said first segment to the two opposite ends of the bottom edge of said second or third side panel, and a fourth segment transversely extending from the point of intersection between said first, second and third segments through said fourth side panel;

a quadrilateral supporting frame set in said tetragonal body, having one side pivotably secured to said first side panel;

a channel member secured to said tetragonal body on an inner surface thereof at the the top edge of said second, third and fourth side panels; and wherein said quadrilateral supporting frame is releaseably engageable with said channel member to stretch open said body; said quadrilateral supporting frame being removeable from said channel member to permit said body to be folded up through said fold lines into a flat structure.

2. The foldable water container of claim 1, wherein said channel member is formed from resilient metal material and bent into shape defining a groove slightly spaced from the inner wall surface of said tetragonal body permitting said quadrilateral supporting frame to be firmly engaged therein and conveniently disengaged therefrom.

* * * * *